United States Patent [19]

Shaw

[11] Patent Number: 5,040,570

[45] Date of Patent: Aug. 20, 1991

[54] COLLECTING DUST AND SELVAGE WASTE RIBBON IN WEAVING MACHINES ONTO A WINDING SPOOL

[75] Inventor: Henry Shaw, Vleteren, Belgium

[73] Assignee: Picanol N.V., Ieper, Belgium

[21] Appl. No.: 589,275

[22] Filed: Sep. 28, 1990

[30] Foreign Application Priority Data

Oct. 4, 1989 [BE] Belgium ..... 8901057

[51] Int. Cl.[5] ..... D03J 1/00

[52] U.S. Cl. ..... 139/1 C; 139/302; 139/430

[58] Field of Search ..... 139/1 C, 291 R, 302, 139/291 C, 430; 26/10.4

[56] References Cited

U.S. PATENT DOCUMENTS

| | | | |
|---|---|---|---|
| 3,678,965 | 7/1972 | Yamada . | |
| 4,084,623 | 4/1978 | Tojo et al. | 139/1 C |
| 4,230,158 | 10/1980 | Hintsch | 139/1 C |
| 4,404,997 | 9/1983 | Ushiro et al. | 139/302 |
| 4,453,572 | 6/1984 | Key | 139/302 |
| 4,532,860 | 8/1985 | Simson . | |
| 4,655,258 | 4/1987 | Breyer et al. . | |
| 4,691,743 | 9/1987 | Venot . | |

FOREIGN PATENT DOCUMENTS

| | | |
|---|---|---|
| 0192014 | 8/1986 | European Pat. Off. . |
| 2576610 | 8/1986 | France . |
| 7018772 | 6/1971 | Netherlands . |
| 1419232 | 12/1975 | United Kingdom . |

*Primary Examiner*—Andrew M. Falik

*Attorney, Agent, or Firm*—Bacon & Thomas

[57] ABSTRACT

A method for collecting dust and waste in weaving machines wherein a continuous waste ribbon is generated during the weaving process includes blowing the dust and waste onto the ribbon while it is being wound on a waste spool to thereby collect and compact the dust and waste matter between ribbon windings. Apparatus for carrying out the method includes a vacuum nozzle arrangement for collecting the dust and waste and a conduit for transporting the aspirated dust and waste to the waste spool while the waste ribbon is being wound thereon. A specific blowing nozzle for carrying the dust and waste to the spool and ribbon, includes a housing arrangement for the waste spool that permits dust and waste not directly deposited on the waste ribbon to be picked up during the ribbon winding process.

25 Claims, 2 Drawing Sheets

COLLECTING DUST AND SELVAGE WASTE RIBBON IN WEAVING MACHINES ONTO A WINDING SPOOL

BACKGROUND OF THE INVENTION

1. Field of The Invention

This invention concerns a method and device for collecting dust and waste in weaving machines.

2. Description of Related Technology

It is known that weaving machines develop relatively large amounts of dust. Traditionally, the dust is collected in weaving machines by means of suction installations which suck up the dust and take it to a dustbin or container, for example as described in DE 2.063.521 (corresponding to U.S. Pat. No. 3,678,965). This method has the disadvantage that the dust is stored in non-compressed form, as a result of which a large volume of dust is formed rather quickly, such that the above-mentioned containers need to be emptied very frequently.

A solution to collect larger amounts of dust in a container is known from the U.S. Pat. No. 4,532,860, whereby the container is provided with a floating lid which compresses the dust collected in the container. Although such a container needs to be emptied less frequently, the disadvantage remains that the use of a container is necessary. Further, the compression of the dust collected in the container is still relatively small.

BRIEF DESCRIPTION OF THE INVENTION

The present invention concerns a method and a device for collecting dust and waste in weaving machines, in particular in weaving machines whereby a waste ribbon is formed which is wound around a waste spool, which do not have the above-mentioned disadvantages, in other words whereby the collection of the dust does not require a traditional container and whereby the dust and possible waste are collected in a very compact manner.

To this end, the invention concerns a method for collecting dust and waste in weaving machines, in particular in a weaving process of the type whereby a waste ribbon is formed which is wound round a waste spool, characterized in that the method consists essentially of that at least a part of the dust and/or waste formed during the weaving process is wound between windings of the waste ribbon. To this end, the dust and similar are sucked up at well-defined places in the weaving machine and subsequently brought into contact with the waste ribbon, for example by blowing the dust on said waste ribbon, such that it is carried along by the waste ribbon and wound between consecutive windings of the waste ribbon. Given the tension with which the waste ribbon is wound around the waste spool, the dust is compressed optimally.

Preferably, a waste spool is used which is provided with a generally confining enclosure or housing, such that the dust which does not stick to the waste ribbon at once, is piled up at the bottom of the space enclosed by the housing until it makes contact with the wound-up waste ribbon and is thus wound up along with the waste ribbon and compressed.

The present invention also concerns apparatus for carrying out the method,

BRIEF DESCRIPTION OF THE DRAWINGS

In order to better explain the characteristics of the invention, by way of example only and without being limitative in any way, the following preferred embodiments of the device according to the invention are described with reference to the accompanying drawings, where.

DETAILED DESCRIPTION OF THE PREFERRED EMBODIMENT

Figure 1:
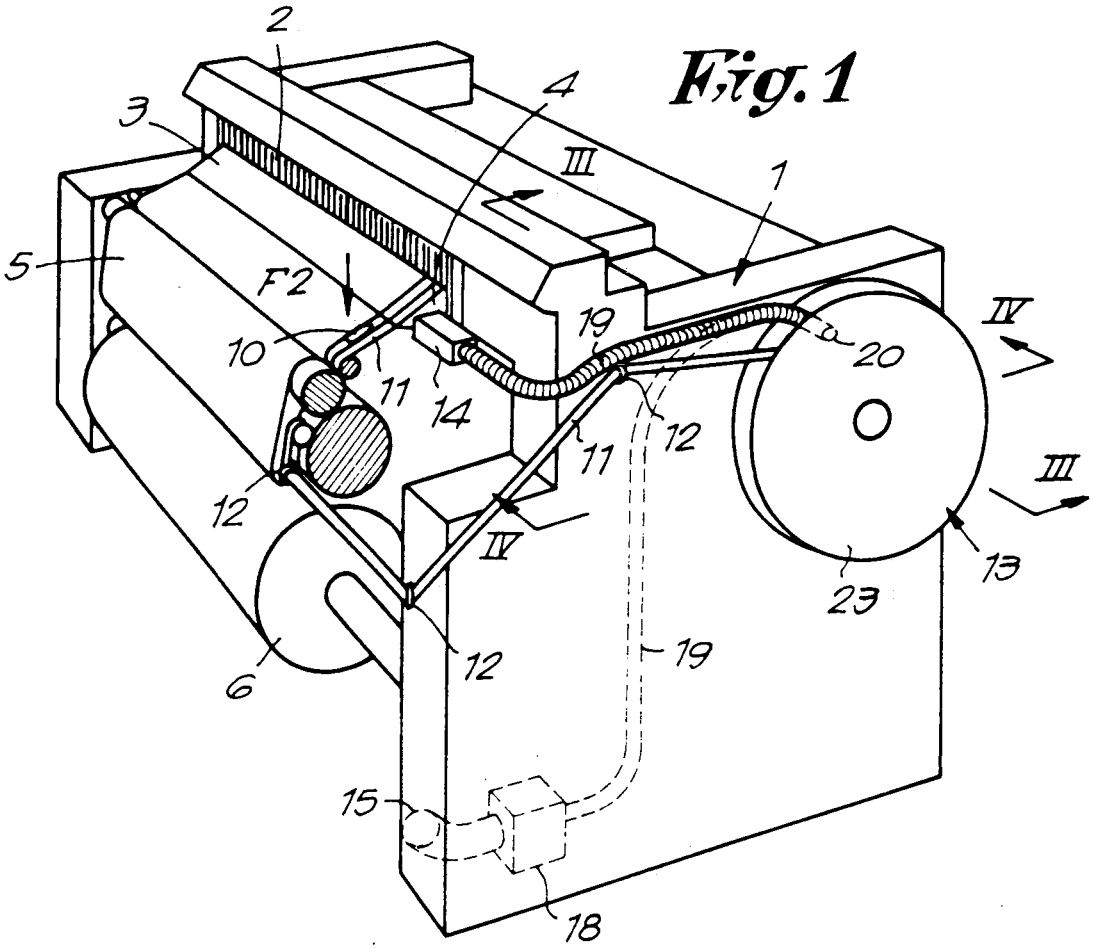
FIG. 1 shows a weaving machine which is provided with a device according to the invention.

FIG. 1 shows a weaving machine which is equipped with a device 1 according to the invention. The generally known parts, also indicated in FIG. 1, are the reed 2, the warp threads 3, the shed 4, the cloth formed 5 and the cloth roll 6.

Figure 2:
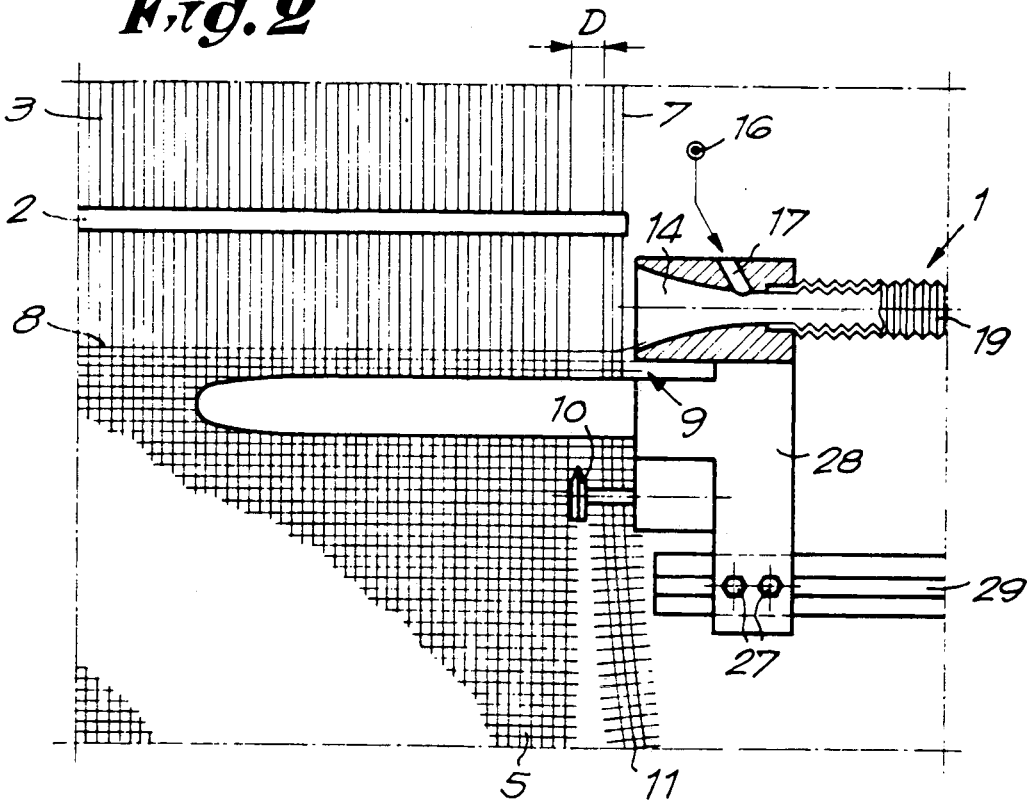
FIG. 2 shows a view according to arrow F2 in FIG. 1.

As shown in FIG. 2, a number of leno threads 7 may be provided next to the traditional warp threads 3, with the aim to hold the weft threads 8, after they have been inserted into the shed 4 at their ends 9. The leno threads 7 are situated at a well-defined distance D from the warp 3, such that the weft threads 8 between the normal warp threads 3 and the leno threads 7 can all be cut at the same length by means of a waste cutter 10.

Hereby a waste ribbon 11 is created which is led in the known way to a waste spool 13 by means of the necessary guide pieces 12, where it is wound up with a constant tension.

FIG. 1 also shows a number of means, preferably consisting of a number of suction nozzles, to pick up dust and possible waste. By way of illustration, FIG. 1 shows a suction nozzle 14 which is placed next to the end of the shed 4, as well as a suction nozzle 15 which is situated underneath the weaving machine.

The suction can be based on various principles.

As indicated in FIG. 2, suction in suction nozzle 14 is obtained by the suction effect of an air current which ends over an angle in the suction nozzle 14 via a supply channel 17 connected to a compressed air source 16 (FIG. 2). It should be stated that the suction nozzle 14 collects the dust which is transported along through the shed 4, and is also meant to collect waste, such as faulty weft threads which must be removed from the shed.

The above-mentioned suction nozzle 15 is, as schematically represented in FIG. 1, connected to a traditional suction installation 18.

In embodiments known to date, the dust sucked up at the suction nozzles 14 and 15 is led through a tube to a container, where the dust and possible waste are caught, this having the disadvantages as described in the introduction.

The present invention offers a solution to these disadvantages in that the dust and waste sucked up at the suction nozzles, in this case the suction nozzles 14 and 15, are wound up between layers of the waste ribbon 11. To this end, the device 1 according to the invention has one or preferably more flexible tubes 19 to lead the dust or waste from the suction nozzles 14 and 15 to the waste spool 13, as well as means, such as a blow opening or nozzle 20 at the end of the above-mentioned tube 19 to bring the dust into contact with the waste ribbon 11 at the height or upper area of the waste spool 13, such that the dust is developed and compressed between wound layers or windings of the waste ribbon.

Figure 3:
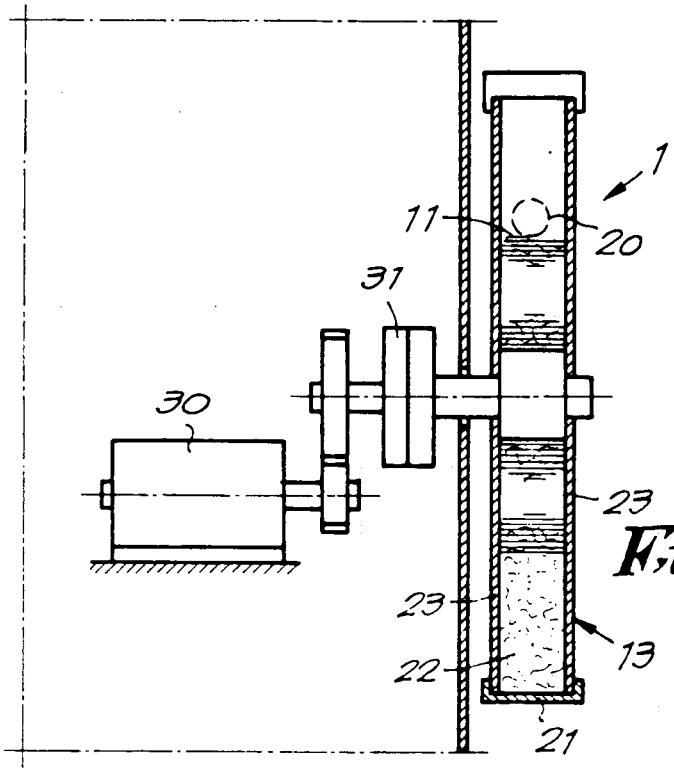
FIGS. 3 and 4 show an embodiment of the device, in particular views corresponding to the cross-sections taken along lines III—III and IV—IV in FIG. 1.
Figure 4:
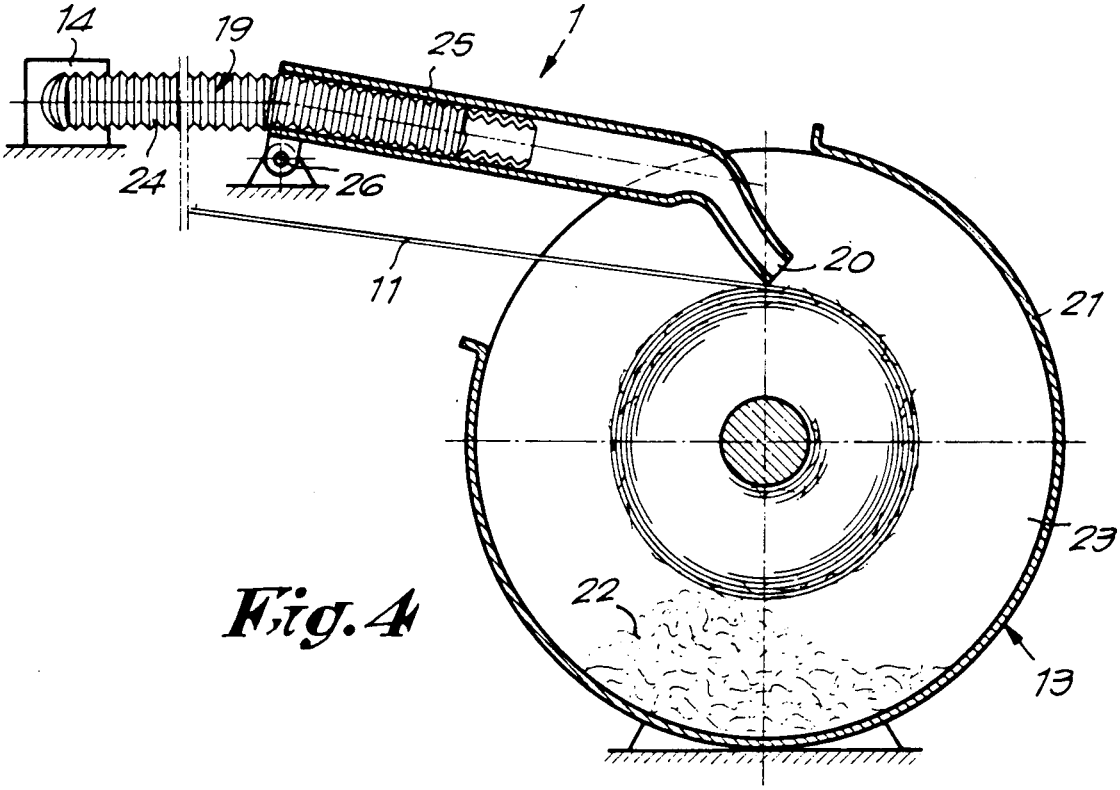

As shown in the embodiment of FIGS. 3 and 4, a generally confining housing or lid 21 may be provided around the periphery of waste spool 13, such that any dust 22 whirling around between the flanges 23 of the waste spool 13 remains present between the spool flanges.

As indicated in FIG. 4, the dust 22 piles up at the bottom of the space formed, until is comes into contact with the wound-up waste ribbon 11, such that it is carried along and eventually is wound up between the waste ribbon windings.

The above-mentioned blow opening 20 is preferably situated above the waste spool 13 and is directed towards the waste ribbon 11.

If a closed housing 21 is used, it is not strictly necessary that the dust and/or waste be blown onto the waste ribbon 11. It suffices that the dust and/or waste is led into the housing 21.

As shown in FIG. 4, the tube 19 between the suction nozzle 14 and the waste spool 13 is preferably telescopic, for example because the flexible part 24 of said tube can be moved freely in a tube-shaped part 25. The tube-shaped part is hung up at its end which is situated opposite the blow opening 20 to a hinge point 26, such that this part 25 continuously rests by its own weight on the wound-up waste ribbon 11 near the blow opening 20, such that the blow opening 20 is permanently presented against said waste ribbon, regardless of the winding diameter.

The above-mentioned telescopic operation allows the suction nozzle 14 to be adjusted in function of the weaving width desired, for example because the screws 27 shown in FIG. 2 are loosened, such that the support 28 with the suction nozzle 14 attached to it may be moved in a slot 29.

The means to drive the waste spool 13 may be chosen arbitrarily. For the sake of completeness, an example is shown in FIG. 3, whereby the drive is done by a motor 30 and a slip coupling 31, whereby the motor turns faster than is required for winding the waste ribbon 11, such that a constant tension is exerted on the waste ribbon 11. The spool 13, as illustrated, rotates in a generally vertical plane about a generally horizontal axis of rotation.

It is clear that the dust and waste 22 can be supplied at an arbitrary place on the waste ribbon 11. Although the most obvious place is at the upper area of the waste spool 13, about the winding waste ribbon it could also be deposited on the ribbon before the winding takes place.

According to a variant, the dust may be blown underneath the waste ribbon 11, in particular between the part running on the waste spool and the part already wound up.

It is clear that apart from the above-mentioned device 1 weaving machines may also have traditional containers for collecting the dust.

The present invention is in no way limited to the embodiments described by way of example and shown in the drawings; on the contrary, such a method and device for collecting dust and waste in weaving machines can be made in various sorts of variants while still remaining within the scope of the invention.

I claim:

1. A method for collecting dust and waste from weaving machines carrying out a weaving process producing a length of waste ribbon comprising the steps of:

winding the waste ribbon on a waste spool;

collecting dust and waste from the weaving machine and transferring the dust and waste to the waste spool;

winding at least part of the dust and waste between windings of the waste ribbon on the waste spool.

2. A method according to claim 1 including bringing said at least a portion of the dust and waste into direct contact with the waste ribbon while it is being wound, whereby the dust and waste are taken along with the ribbon and wound between the waste ribbon windings.

3. The method according to claim 2 wherein the dust and waste are brought into contact with the waste ribbon by blowing the dust and waste onto the ribbon.

4. The method according to claim 1, 2 or 3, wherein the dust and waste are collected by suction in the weaving machine.

5. The method according to claim 1, 2 or 3 wherein the waste spool rotates in a vertical plane and including bringing the dust and waste into contact with the waste ribbon in the upper area of the waste spool.

6. A method according to claim 1, 2 or 3 wherein the dust and waste are brought into contact with the waste ribbon by winding the waste ribbon up on the spool within a generally confining enclosure and by transporting the dust and waste to the enclosure.

7. A method according to claim 6 wherein the waste spool rotates in a vertical plane and including transporting the dust and waste to the upper area of the waste spool.

8. A method according to claim 6 including winding the waste ribbon on the waste spool under tension.

9. A method according to claim 1, 2 or 3 including winding the waste ribbon on the waste spool under tension.

10. Dust and waste collection apparatus for a weaving machine carrying out a weaving process producing a length of waste ribbon comprising:

spool means and means for winding a length of waste ribbon on the spool means;

means for collecting dust and waste from the weaving machine and means for transporting same to the spool means;

means for delivering the transported dust and waste to the ribbon at the spool means and winding the dust and waste between ribbon windings on the spool means.

11. Dust and waste collection apparatus as claimed in claim 10 wherein the means for collecting the dust and waste comprises at least one suction nozzle.

12. Dust and waste collection apparatus as claimed in claim 11 wherein the weaving machine includes a shed and wherein the means for collecting the dust and waste comprises at least one suction nozzle disposed at one end area of the shed.

13. Dust and waste collection apparatus as claimed in claim 12 wherein the suction nozzle at the end of the shed is adjustable widthwise of the weaving machine to accommodate various weaving widths of the weaving machine.

14. Dust and waste collection apparatus as claimed in claim 13 wherein the means for transporting the dust and waste comprises tube means in communication with the suction nozzle and for discharging the waste at the spool means, said tube means being at least in part flexible.

15. Dust and waste collection means as claimed in claim 13 or 14 wherein said tube means is at least in part variable in length.

16. Dust and waste collection apparatus as claimed in claim 14 wherein said tube means includes a distal hinged portion at its discharge end that is arranged to contact and to radially follow a point on the circumference of the waste ribbon while it is being wound on the spool means.

17. Dust and waste collection apparatus as claimed in claim 10 including a generally confining housing for the spool means.

18. Dust and waste collection means as claimed in claim 10 wherein said spool means lies in a generally vertical plane and said means for delivering the dust and waste to the spool means comprises means to bring the dust and waste into contact with the waste ribbon at the upper area of the spool means.

19. Dust and waste collection apparatus as claimed in claim 18 including a generally confining housing for the spool means.

20. Dust and waste collection means as claimed in claim 18 wherein said means for delivering the dust and waste to the spool means comprises a blow nozzle; means for blowing said dust and waste through said blow nozzle; said blow nozzle being oriented to direct dust and waste against said waste ribbon while it is being wound on said spool means.

21. Dust and waste collection apparatus as claimed in claim 20 wherein the means for collecting dust and waste comprises a suction nozzle associated with the weaving machine and wherein the means for transporting the dust and waste comprising tube means in communication with the suction nozzle and said blow nozzle; and means for moving an airstream through said suction nozzle, tube means and blow nozzle.

22. Dust and waste collection apparatus as claimed in claim 20 or 21 wherein said spool means rotates in a vertical plane and the blow nozzle is disposed at the top area of the spool means and is oriented to discharge dust and waste in the winding direction of the spool means.

23. Dust and waste collection apparatus as claimed in claim 10 including drive means for rotating the spool means, said driving means including a drive motor and means for enabling the drive motor to exert a constant tension on the waste ribbon during winding of the waste ribbon.

24. Dust and waste collection apparatus as claimed in claim 23 including drive transmission means between the drive motor and the spool means; and wherein said means for enabling the drive motor to exert a constant tension on the waste ribbon comprises a slip coupling in said drive transmission.

25. Dust and waste collection apparatus as claimed in claim 10 wherein said means for winding waste ribbon on the spool means includes means for winding the ribbon under tension; housing means for the spool means for generally confining any dust and waste delivered to the spool means and not wound between the ribbon windings.

* * * * *